US008869342B2

(12) United States Patent
Yoon et al.

(10) Patent No.: US 8,869,342 B2
(45) Date of Patent: Oct. 28, 2014

(54) ROBOT CLEANER AND METHOD OF CONTROLLING THE SAME

(71) Applicant: Samsung Electronics Co., Ltd., Suwon-si (KR)

(72) Inventors: Sang Sik Yoon, Suwon (KR); Hee Won Jin, Seoul (KR); Byung Chan Kim, Yongin (KR); Yeon Kyu Jeong, Suwon (KR); Sang Hwa Choi, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/857,649

(22) Filed: Apr. 5, 2013

(65) Prior Publication Data

US 2013/0263889 A1 Oct. 10, 2013

(30) Foreign Application Priority Data

Apr. 6, 2012 (KR) ..... 10-2012-0036139

(51) Int. Cl.

*A47L 9/00* (2006.01)
*A47L 11/00* (2006.01)
*A47L 9/04* (2006.01)

(52) U.S. Cl.

CPC ..... *A47L 2201/04* (2013.01); *A47L 2201/06* (2013.01); *A47L 9/0494* (2013.01); *A47L 9/04* (2013.01)

USPC ..... 15/319; 15/340.3; 15/340.4; 15/49.1; 15/98; 15/42; 134/18; 700/245

(58) Field of Classification Search

CPC ..... A47L 2201/00; A47L 2201/06; A47L 2201/04

USPC ..... 15/319, 340.1, 340.4, 41.1, 42, 49.1, 15/98; 134/18; 700/245

See application file for complete search history.

(56) References Cited

U.S. PATENT DOCUMENTS

| | | | | | |
|---|---|---|---|---|---|
| 5,309,592 | A * | 5/1994 | Hiratsuka | ..... | 15/49.1 |
| 5,402,051 | A * | 3/1995 | Fujiwara et al. | ..... | 318/587 |
| 5,720,077 | A * | 2/1998 | Nakamura et al. | ..... | 15/340.1 |
| 5,815,880 | A * | 10/1998 | Nakanishi | ..... | 15/319 |
| 6,370,453 | B2 * | 4/2002 | Sommer | ..... | 701/23 |

FOREIGN PATENT DOCUMENTS

| | | |
|---|---|---|
| KR | 2003-0066992 | * 8/2003 |
| WO | 2012/147230 | * 11/2012 |

* cited by examiner

*Primary Examiner* — Mark Spisich
(74) *Attorney, Agent, or Firm* — Staas & Halsey LLP

(57) ABSTRACT

A robot cleaner that automatically removes dust accumulated on a floor while navigating a cleaning area, and a method of controlling the robot cleaner, includes a main body that navigates a floor; a first detector that detects an obstacle getting closer to the main body; an auxiliary cleaner that is mounted on the main body to protrude and retract; a second detector that detects a protrusion state or a retraction state of the auxiliary cleaner; and a controller that determines an abnormal operation of the auxiliary cleaner based on a result of the detection of the second detector and controls a protrusion operation or a retraction operation of the auxiliary cleaner according to a result of the determination.

26 Claims, 17 Drawing Sheets

ROBOT CLEANER AND METHOD OF CONTROLLING THE SAME

CROSS-REFERENCE TO RELATED APPLICATIONS

This application claims the benefit of Korean Patent Application No. 10-2012-0036139, filed on Apr. 6, 2012 in the Korean Intellectual Property Office, the disclosure of which is incorporated herein by reference.

BACKGROUND

1. Field

One or more embodiments relate to a robot cleaner that automatically removes dust accumulated on a floor while navigating a cleaning area and a method of controlling the robot cleaner.

2. Description of the Related Art

A robot cleaner refers to a device that automatically cleans a cleaning area by absorbing foreign substances such as dust from a floor while navigating a cleaning area without a user's manipulation.

A robot cleaner includes a main brush for removing dust accumulated under a main body of the robot cleaner, and an auxiliary cleaning tool for cleaning a near-wall portion or the like to improve cleaning performance. The auxiliary cleaning tool of the robot cleaner protrudes outward from the main body of the robot cleaner and removes dust or the like on a floor, particularly, on the near-wall portion.

However, when the auxiliary cleaning tool has an error and thus fails to operate normally, since a conventional robot cleaner does not include a unit for detecting an error of the auxiliary cleaning tool, an abnormal state of the auxiliary cleaning tool may remain for a predetermined period of time. An abnormal operation of the auxiliary cleaning tool may be caused by a collision with an obstacle that is disposed adjacent to the conventional robot cleaner or by a material of the floor with high resistance, or may be caused when a user arbitrarily lifts up the conventional robot cleaner that is navigating. In this case, since the abnormal state of the auxiliary cleaning tool remains for a predetermined period of time, the conventional robot cleaner may no longer efficiently clean the floor.

SUMMARY

The foregoing described problems may be overcome and/or other aspects may be achieved by one or more embodiments of a robot cleaner that detects an abnormal operation of an auxiliary cleaner, classifies causes of the abnormal operation, and performs an operation in response to the abnormal operation, and a method of controlling the robot cleaner.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a robot cleaner may include: a main body that navigates a floor; a first detector that detects an obstacle getting closer to the main body; an auxiliary cleaner that is mounted on the main body to protrude and retract; a second detector that detects a protrusion state or a retraction state of the auxiliary cleaner; and a controller that determines an abnormal operation of the auxiliary cleaner based on a result of the detection of the second detector and controls a protrusion operation or a retraction operation of the auxiliary cleaner according to a result of the determination.

The second detector may detect whether the auxiliary cleaner performs a protrusion operation or a retraction operation, detect a protrusion degree or a retraction degree of the auxiliary cleaner, and detect whether the protrusion operation or the retraction operation of the auxiliary cleaner is completed.

The controller may calculate a number of times a driving unit that drives the auxiliary cleaner rotates based on the result of the detection of the second detector, and when the number of times the driving unit rotates for a preset period of time is less than a critical value, may determine that an error has occurred in an operation of the auxiliary cleaning unit.

the controller may calculate a number of times a driving unit that drives the auxiliary cleaner rotates based on the result of the detection of the second detector, and when the number of times the driving unit rotates for a preset period of time is greater than a critical value even though there is no protrusion or retraction command for the auxiliary cleaner, may determine that an error has occurred in an operation of the auxiliary cleaning unit.

The controller may calculate an amount of current supplied to a driving unit that drives the auxiliary cleaner based on the result of the detection of the second detector, and when the amount of current supplied to the driving unit for a preset period of time is less than a critical value, may determine that an error occurs in an operation of the auxiliary cleaning unit.

The controller may calculate an amount of current supplied to a driving unit that drives the auxiliary cleaner based on the result of the detection of the second detector, and when the amount of current supplied to the driving unit for a preset period of time is greater than a critical value even though there is no protrusion or retraction command for the auxiliary cleaner, may determine that an error occurs in an operation of the auxiliary cleaning unit.

The controller may estimate a position of the auxiliary cleaner based on the result of the detection of the second detector, and when the auxiliary cleaner is not located at a predicted position within a preset period of time, may determine that an error has occurred in an operation of the auxiliary cleaning unit.

The controller may estimate a position of the auxiliary cleaner based on the result of the detection of the second detector, and when there is a change in the position of the auxiliary cleaner even though there is no protrusion or retraction command for the auxiliary cleaner, may determine that an error has occurred in an operation of the auxiliary cleaning unit.

When an obstacle is detected in a protrusion or retraction direction of the auxiliary cleaner based on the result of the detection of the first detector, the controller may determine the auxiliary cleaner has operated abnormally due to the obstacle.

The controller may perform a protrusion or retraction operation of the auxiliary cleaner or change a navigation direction and a navigation pattern of the main body in response to the obstacle.

When no obstacle is detected in a protrusion or retraction direction of the auxiliary cleaner based on the result of the detection of the first detector, the controller may determine that the auxiliary cleaner has operated abnormally due to a change in a floor surface.

The controller may perform a protrusion or retraction operation of the auxiliary cleaner or adjusts an operation strength of the auxiliary cleaner in response to the change in the floor surface.

When a protrusion or retraction operation of the auxiliary cleaner is detected based on the result of the detection of the second detector even though there is no operation command for the auxiliary cleaner, the controller may determine that an undesired operation has occurred.

The controller may determine that the undesired operation has been caused by an external force, and control the auxiliary cleaner to resist the external force in order to maintain a previous state.

In accordance with another aspect of the present invention, a method of controlling a robot cleaner that may include a main body that navigates a floor, a first detector that detects an obstacle getting closer to the main body, an auxiliary cleaner that is mounted on the main body to protrude and retract, and a second detector that detects a protrusion or retraction state of the auxiliary cleaner, may include: determining an abnormal operation of the auxiliary cleaner based on a result of the detection of the second detector; and controlling a protrusion or retraction operation of the auxiliary cleaner according to a result of the determination.

The controlling of the protrusion or retraction operation of the auxiliary cleaner may include: determining whether an obstacle is detected in a protrusion or retraction direction of the auxiliary cleaner; determining whether the auxiliary cleaner operates abnormally due to the obstacle when it is determined that the obstacle is detected; and performing a protrusion or retraction operation of the auxiliary cleaner or changing a navigation direction and a navigation pattern of the main body in response to the obstacle.

The controlling of the protrusion or retraction operation of the auxiliary cleaner may include: determining whether an obstacle is detected in a protrusion or retraction direction of the auxiliary cleaner; determining that the auxiliary cleaner operates abnormally according to a change in a floor surface when the obstacle is not detected; and performing a protrusion or retraction operation of the auxiliary cleaner or adjusting an operation strength of the auxiliary cleaner in response to the change in the floor surface.

The method may further include determining whether there exists an operation command for the auxiliary cleaner, wherein the determining of the abnormal operation of the auxiliary cleaner includes determining whether a protrusion or retraction operation of the auxiliary cleaner is detected based on the result of the detection of the second detector even though there is no operation command for the auxiliary cleaning unit.

The controlling of the protrusion or retraction operation of the auxiliary cleaner may include: when a protrusion or retraction operation of the auxiliary cleaner is detected, determining that an undesired operation occurs; and determining that the undesired operation is caused by an external force and controlling the auxiliary cleaner to resist the external force in order to maintain a previous state.

According to the present invention, since an abnormal operation of an auxiliary cleaner may be detected and a response operation may be performed by classifying causes of the abnormal operation, an error of the auxiliary cleaner may be corrected and cleaning may be performed.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
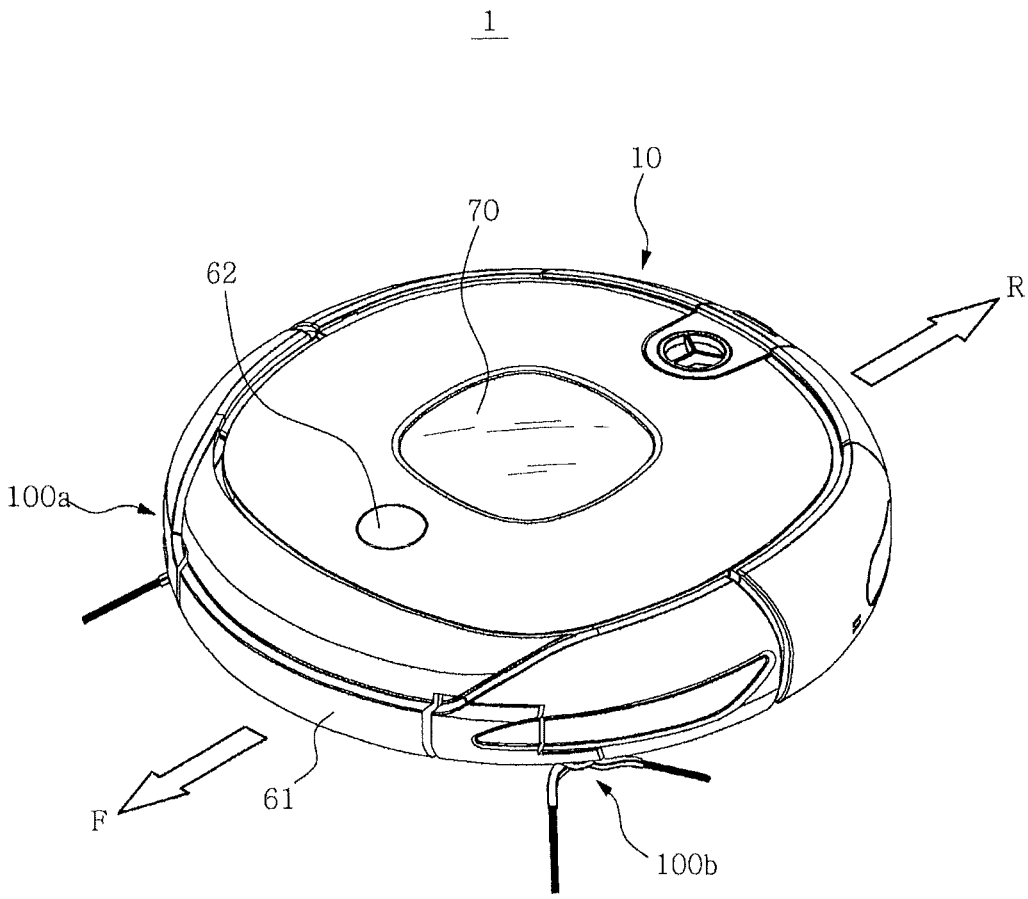
FIG. 1 is a perspective view illustrating an outer appearance of a robot cleaner according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

FIG. 1 is a perspective view illustrating an outer appearance of a robot cleaner 1 according to one or more embodiments.

Referring to FIG. 1, the robot cleaner 1 may include a main body 10 that forms the outer appearance and auxiliary cleaners 100*a* and 100*b* (collectively denoted by 100) that clean a near-wall portion and a corner portion.

Various sensors for detecting an obstacle may be coupled to the main body 10 and may include a proximity sensor 61 and/or a vision sensor 62. For example, when the robot cleaner 1 navigates in an arbitrary direction without a determined path, that is, in a cleaning system with no map, the robot cleaner 1 may detect an obstacle by using the proximity sensor 61 and may navigate a cleaning area. By contrast, when the robot cleaner 1 navigates along a determined path, that is, in a cleaning system requiring a map, the vision sensor 62 that receives position information of the robot cleaner 1 and generates a map may be provided, and other various methods may be used.

Also, a display unit 70 may be coupled to the main body 10 and may display various states of the robot cleaner 1. The display unit 70 may display, for example, a battery state of charge, whether a dust-collecting device is full, or a cleaning mode of the robot cleaner 1.

A structure of each auxiliary cleaner 100 will be explained below in detail with reference to FIGS. 3 through 6.

Figure 2:
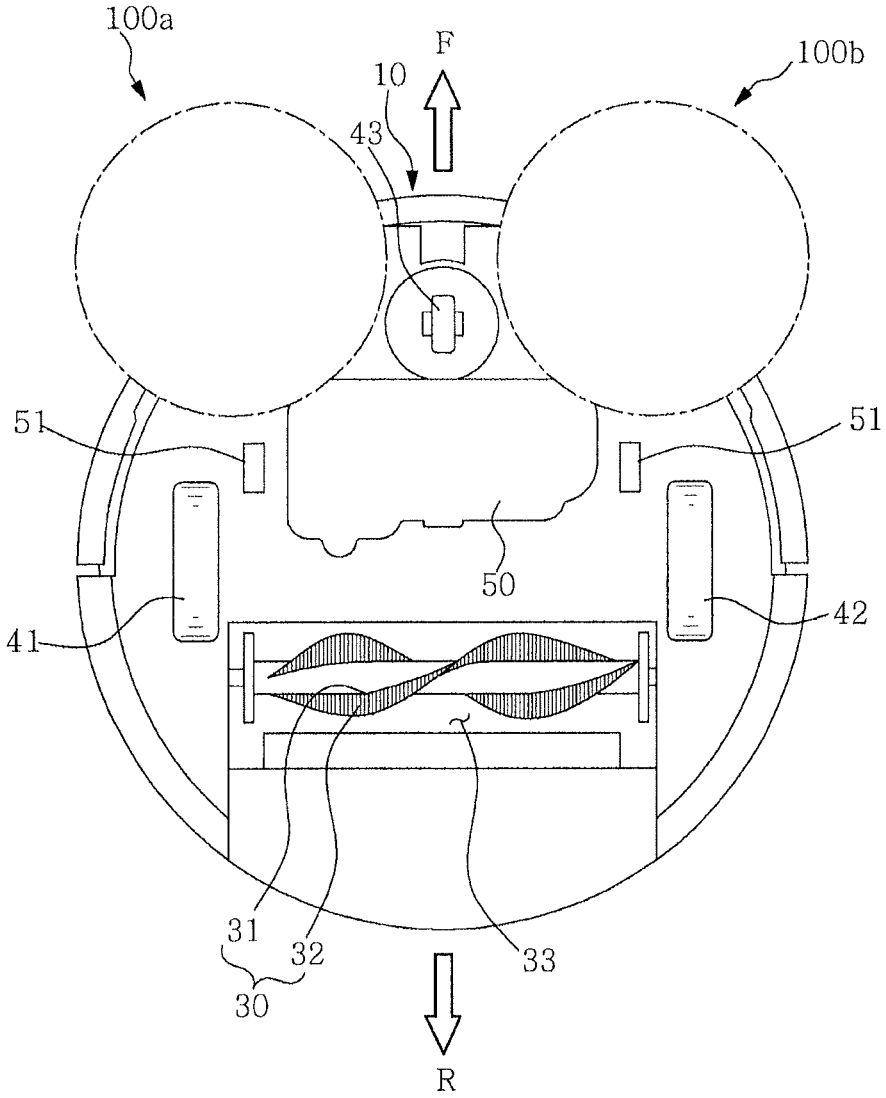
FIG. 2 is a cross-sectional view illustrating a structure of a bottom surface of a robot cleaner according to one or more embodiments, such as the robot cleaner of FIG. 1.

FIG. 2 is a cross-sectional view illustrating a structure of a bottom surface of a robot cleaner according to one or more embodiments, such as the robot cleaner 1 of FIG. 1.

Referring to FIGS. 1 and 2, the robot cleaner 1 may include a main brush unit 30, a power supply 50, driving wheels 41 and 42, a caster 43, and the auxiliary cleaners 100*a* and 100*b*.

The main brush unit 30 may be mounted in an opening formed in a rear portion R of the bottom surface of the main body 10. The main brush unit 30 may sweep dust accumulated on a floor on which the main body 10 is put into a dust inlet 33. The opening of the bottom surface of the main body 10 in which the main brush unit 30 may be mounted is the dust inlet 33.

The main brush unit 30 may include a roller 31 and a main brush 32 on an outer surface of the roller 31. As the roller 31 rotates, the main brush 32 may sweep dust accumulated on the floor into the dust inlet 33.

Although not shown in FIG. 2, a ventilation device that generates a suction force may be provided in the dust inlet 33 and may transfer the dust swept into the dust inlet 33 to the dust collecting device.

The power supply 50 may supply driving power for driving the main body 10. The power supply 50 may include various driving devices for driving various parts mounted on the main body 10 and a battery that may be electrically connected to the main body 10 and may supply driving power. The battery may be a rechargeable secondary battery. When a cleaning process is completed and the main body 10 is coupled to a charger or a discharge station, the battery may be supplied with power from the charger or the discharge station to be charged.

The driving wheels 41 and 42 may be symmetrically disposed on left and right edges of a central area of the bottom surface of the main body 10. While the robot cleaner 1 performs the cleaning process, the driving wheels 41 and 42 may navigate forward or backward, or rotate.

The caster 43 may be provided on a front edge of the bottom surface of the main body 10 in a navigation direction of the robot cleaner 1, to help the main body 10 to maintain a stable posture. The driving wheels 41 and 42 and the caster 43 may constitute one assembly and may be detachably mounted on the main body 10.

Openings may be formed at both sides of a front portion F of the bottom surface of the main body 10, and the auxiliary cleaning units 100*a* and 100*b* may be provided to cover the openings.

A structure of the auxiliary cleaner 100 will be explained in detail with reference to FIGS. 3 through 6.

The auxiliary cleaner 100 may be mounted to the bottom surface of the robot cleaner 1 to protrude and retract from and to the robot cleaner 1. The auxiliary cleaner 100 may have any of various structures, and two structures according to one or more embodiments will be explained, but the structure of the auxiliary cleaner 100 is not limited thereto.

Figure 3:
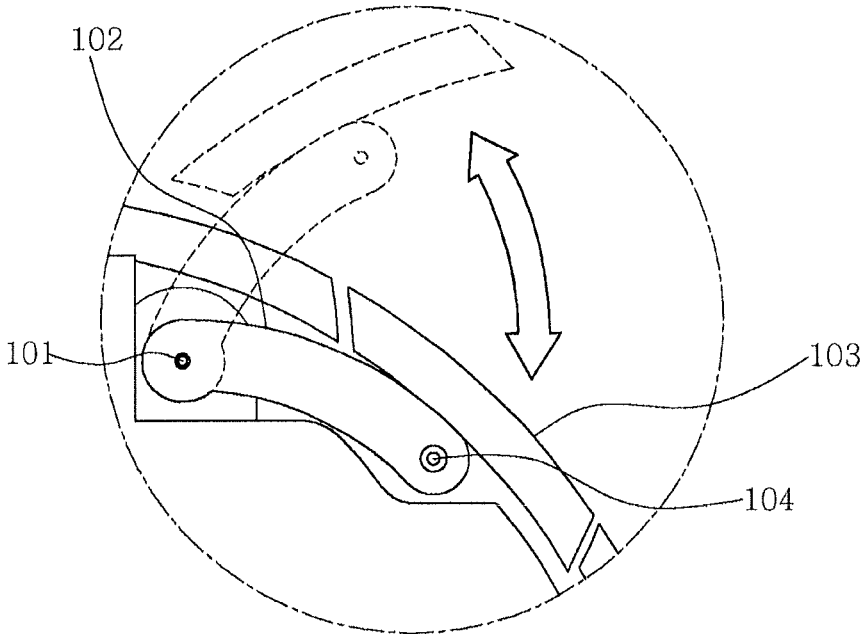
FIG. 3 is a cross-sectional view illustrating a structure of an auxiliary cleaner that protrudes or retracts, according to one or more embodiments.

FIG. 3 is a cross-sectional view illustrating a structure of the auxiliary cleaner 100 that protrudes or retracts, according to one or more embodiments.

Referring to FIG. 3, the auxiliary cleaner 100 may include a side arm 102, a rim cover 103, and an auxiliary cleaning tool 110.

The side arm 102 may be coupled to a lower portion of a front side of the main body 10, and an arm motor (not shown) that may drive the side arm 102 may be located in an upper portion of the side arm 102. The arm motor may be connected to a rotating shaft (not shown) via a predetermined gear that may transmit a driving force to the side arm 102, and the rotating shaft may be mounted in a coupling groove 101 formed in one end of the side arm 102.

Accordingly, when the arm motor is driven, the rotating shaft may rotate and the side arm 102 may pivot about the coupling groove 101. In this case, as the side arm 102 pivots to the outside of the main body 10, the rim cover 103 may no longer cover the opening of the main body 10 and may no longer form a side rim of the main body 10.

A coupling groove 104 to which the auxiliary cleaning tool 110 may be coupled may be formed in the other end of the side arm 102. A rotary motor (not shown) that drives the auxiliary cleaning tool 110 may be located in an upper portion of the other end of the side arm 102, and the auxiliary cleaning tool 110 may rotate about the coupling groove 104 due to a driving force of the rotary motor.

Figure 4:
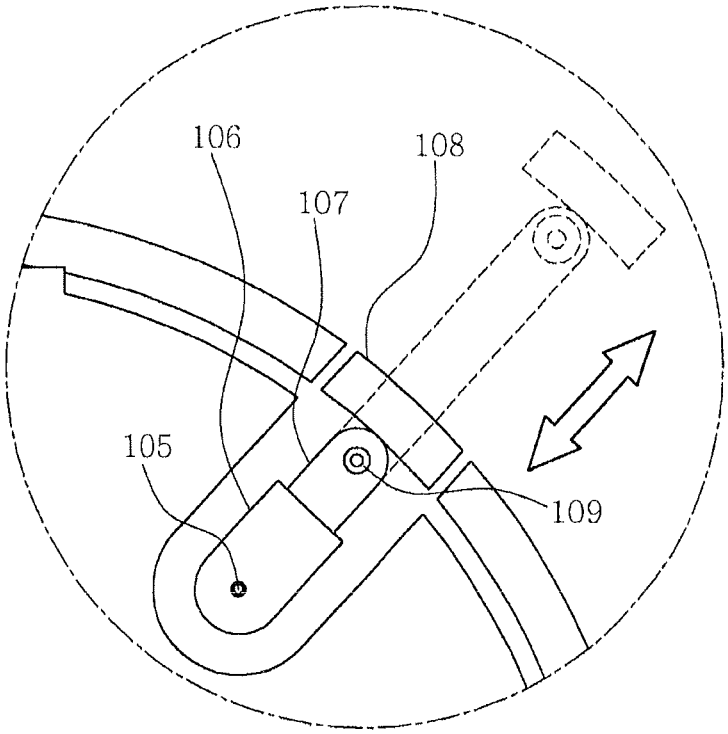
FIG. 4 is a cross-sectional view illustrating a structure of an auxiliary cleaner that protrudes or retracts, according to one or more embodiments.

FIG. 4 is a cross-sectional view illustrating a structure of an auxiliary cleaner 100 that protrudes or retracts, according to one or more embodiments.

Referring to FIG. 4, the auxiliary cleaner 100 may include a side arm 106, a rim cover 108, and the auxiliary cleaning tool 110.

The side arm 106 may be coupled through a coupling groove 105 to a lower portion of a front side of the main body 10, and an extension arm 107 that may slidably extend to the outside of the side arm 106 may be received in the side arm 106.

The extension arm 107 may move forward and backward in a longitudinal direction of the side arm 106 in the side arm 106. To this end, a rail may be formed in the side arm 106, a guide loop (not shown) may be formed on the extension arm 107, and the extension arm 107 may slidably move along the rail while being fixed to the rail. Also, another extension arm that may slidably extend to the outside of the extension arm 107 may be received in the extension arm 107. The other extension arm may move in the same manner, and the number of extension arms is not limited.

An arm motor (not shown) that drives the extension arm 107 may be received in an upper portion of the side arm 106. The arm motor may transmit a driving force to the extension arm 107. When the arm motor is driven, the extension arm 107 may slide to the outside of the side arm 106 and may protrude to the outside of the main body 10. In this case, the rim cover 108 may no longer cover the opening of the main body 10 and may no longer form a side rim of the main body 10.

A coupling groove 109 to which the auxiliary cleaning tool 110 may be coupled may be formed in an end of the extension arm 107. A rotary motor (not shown) that drives the auxiliary cleaning tool 110 may be received in an upper portion of the end of the extension arm 107, and the auxiliary cleaning tool 110 may rotate about the coupling groove 109 due to a driving force of the rotary motor.

In the auxiliary cleaner 100, the auxiliary cleaner 100 may protrude by receiving a force from, for example, a spring instead of a motor. Also, as described above, a rotating shaft of the auxiliary cleaning tool 110 may not be the same as a rotating shaft of the motor and may be connected, for example, by a gear, a belt, or the like.

The auxiliary cleaner 100 may include the auxiliary cleaning tool 110, and the auxiliary cleaning tool 110 may clean a near-wall portion. The auxiliary cleaning tool 110 may include a brush that collects or scatters foreign substances such as dust, a dustcloth that cleans a floor, and an absorber that absorbs foreign substances such as dust. However, the auxiliary cleaning tool 110 is not limited to a specific type.

Figure 5:
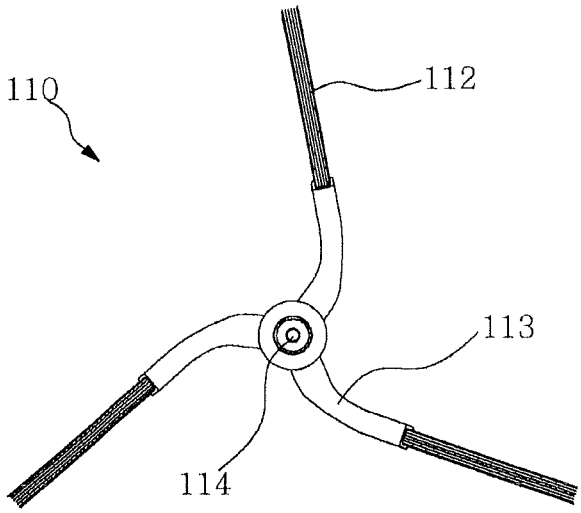
FIG. 5 is a view illustrating a structure of an auxiliary cleaning tool, according to one or more embodiments.

FIG. 5 is a view illustrating a structure of the auxiliary cleaning tool 110, according to one or more embodiments.

Referring to FIG. 5, the brush arm 113 may extend outward in a radial direction of the auxiliary cleaning tool 110. An auxiliary brush 112 may be coupled to the brush arm 113, and a rotating shaft 111 that may protrude from the brush arm 113 may be coupled to the side arm 102 or the extension arm 107 through a coupling groove. When the auxiliary cleaning tool 110 rotates, the auxiliary brush 112 may sweep dust accumulated on a near-wall portion toward the central area of the main body 10.

Figure 6:
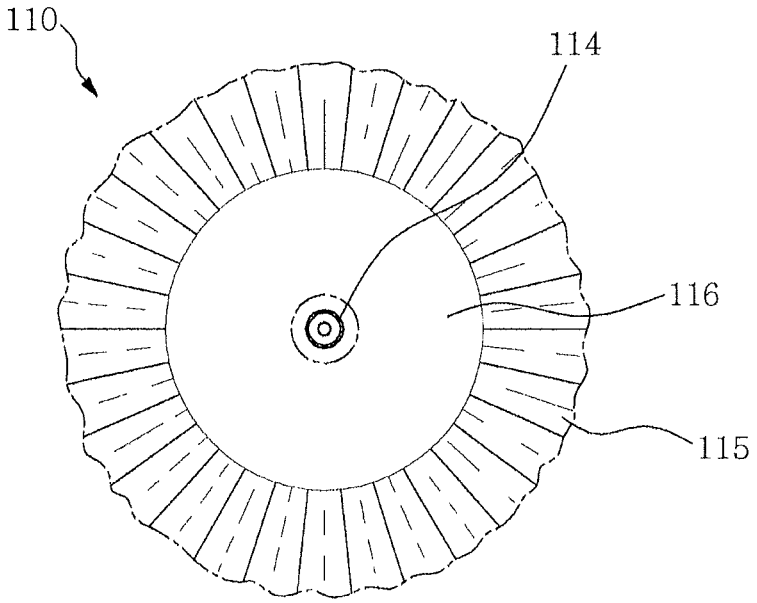
FIG. 6 is a view illustrating a structure of an auxiliary cleaning tool, according to one or more embodiments.

FIG. 6 is a view illustrating a structure of an auxiliary too, such as the auxiliary cleaning tool 110, according to one or more embodiments.

Referring to FIG. 6, a dustcloth holder 116 may be formed in a radial direction of the auxiliary cleaning tool 110, and an auxiliary dustcloth 115 may be mounted in a radial direction of the dustcloth holder 116 on the dustcloth holder 116. A rotating shaft 114 that may receive a driving force of the rotary motor and may rotate the auxiliary cleaning tool 110 may protrude from the center of the dustcloth holder 116, and the rotating shaft 114 may be coupled to the side arm 102 or the extension arm 107 through a coupling groove. When the auxiliary cleaning tool 110 rotates, the auxiliary dustcloth 115 may clean a near-wall portion.

When the auxiliary cleaning tool 110 of FIG. 6 is applied to the auxiliary cleaner 100 of FIG. 4, a cleaning operation of the auxiliary cleaner 100 may be performed when the auxiliary cleaning tool 110 rotates and the extension arm 107 repeatedly protrudes and retracts. Also, a cleaning operation may be performed when only the extension arm 107 repeatedly protrudes and retracts without any rotation of the auxiliary cleaning tool 110.

The auxiliary brush 112 may be formed of any of various elastic materials, and the auxiliary dustcloth 115 may be formed of any of various materials such as, for example, a fibrous material.

Since a cleaning area may be widened due to the auxiliary cleaner 100 that protrudes to the outside of the main body 10, the robot cleaner 1 may clean even a near-wall portion or a corner portion of the floor.

Although two auxiliary cleaning units 100*a* and 100*b* may be provided on both side portions of the robot cleaner 1 in FIGS. 1 through 6, the present embodiment is not limited thereto and a number and positions of the auxiliary cleaning units 100 are not limited. However, for convenience of explanation, in the following description, it is assumed that two auxiliary cleaning units 100 may be provided on both side portions of the robot cleaner 1 as shown in FIGS. 1 through 6.

In the following description, it is assumed that a cleaning process may be basically performed by the main brush unit 30 while the robot cleaner 1 navigates. Also, for convenience of explanation, it is assumed that the auxiliary cleaning tool 110 may be a brush type.

Figure 7:
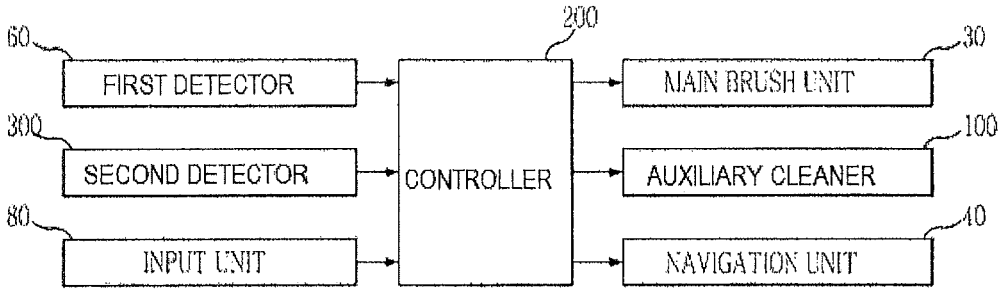
FIG. 7 is a block diagram illustrating a control structure of a robot cleaner, according to one or more embodiments.

FIG. 7 is a block diagram illustrating a control structure of a robot cleaner, according to one or more embodiments.

Referring to FIG. 7, the robot cleaner 1 may include a first detector 60 that may detect an environment of the robot cleaner 1, a second detector 300 that may detect an operation of the auxiliary cleaner 100, an input unit 80 that may receive a command related to navigation or a cleaning operation of the robot cleaner 1 from a user, a controller 200 that may control the navigation and/or the cleaning operation of the robot cleaner 1 according to the command input to the input unit 80 or a result of the detection of the first and second detection units 60 and 300, the main brush unit 30 and the auxiliary cleaner 100 that may perform the cleaning operation of the robot cleaner 1, and a navigation unit 40 that may be in charge of the navigation of the robot cleaner 1.

The first detector 60 may detect an obstacle. Examples of the first detector 60 that detects an obstacle may include, for example, an ultrasonic sensor, a light sensor, or a proximity sensor, etc. When the first detector 60 is an ultrasonic sensor, the first detector 60 may detect an obstacle by transmitting ultrasound waves to a navigation path and receiving reflected ultrasound waves. When the first detector 60 is a light sensor, an infrared light-emitting element may emit infrared rays, and an infrared receiving element may receive reflected infrared rays to detect an obstacle. In addition, the first detector 60 may be, for example, a proximity sensor, a contact sensor, or a vision sensor. As long as the first detector 60 may detect an obstacle, the first detector 60 is not limited to a specific construction.

The second detector 300 may detect whether the auxiliary cleaner 100 performs a protrusion operation or a retraction operation. Also, the second detector 300 may detect a protrusion degree or a retraction degree of the auxiliary cleaner 100, and may detect whether the protrusion operation or the retraction operation of the auxiliary cleaner 100 is completed.

In order to detect a protrusion or retraction state of the auxiliary cleaner 100, the second detector 300 may include a contact sensor such as a micro-switch, a circuit that detects a counter-electromotive force of an arm motor, a hall sensor that detects a number of times the arm motor rotates, or a photo sensor. A detailed structure of the second detector 300 will be explained below in detail when a structure of detecting an operation of the auxiliary cleaner 100 is described.

The input unit 80 may receive a command related to a cleaning operation or a navigation of the robot cleaner 1 from the user. Basically, a cleaning start command or a cleaning end command may be input by inputting an on/off signal, and a command related to a navigation mode and a cleaning mode may be input. The input unit 80 may be provided on the main body 10 of the robot cleaner 1 as a button type, or may be provided on the display unit 70 as a touch panel type, for example.

The controller 200 may detect an error of the auxiliary cleaner 100 and accordingly may control the robot cleaner 1 to clean and navigate. To this end, the controller 200 may include an error detector 210 that may detect an error of the auxiliary cleaner 100, a cleaning controller 220 that may control the main brush unit 30 and the auxiliary cleaner 100 for a cleaning operation of the robot cleaner 1, and a navigation controller 230 that may control the navigation unit 40 for a navigation of the robot cleaner 1. A structure and an operation of the controller 200 will be explained in detail below.

The main brush unit 30 may include the roller 31 and the main brush 32 placed into the outer surface of the roller 31 as described above. When the cleaning controller 220 transmits a control signal to a driving motor that drives the roller 31, the roller 31 may begin to rotate according to the control signal. As the roller 31 rotates, the main brush 32 may sweep dust accumulated on the floor into the dust inlet 33 and a cleaning operation of the main brush unit 30 may be performed.

The auxiliary cleaner 100 may clean a corner portion which the main brush unit 30 may not reach. The term 'corner portion' used herein refers to a portion formed when an obstacle including a wall and a floor contact each other. The auxiliary cleaner 100 may clean a corner portion which the main brush unit 30 may not reach. The auxiliary cleaner 100 may include the side arms 102 and 106 and/or the extension arm 107 which may be in charge of a protrusion operation and a retraction operation of the auxiliary cleaner 100, a rotary motor that may rotate the auxiliary cleaning tool 110, and an arm motor that may drive the side arms 102 and 106 and/or the extension arm 107.

The navigation unit 40 may include the driving wheels 41 and 42, the caster 43, and a driving unit that may drive the driving wheels 41 and 42 and the caster 43 as described above. The navigation controller 230 may transmit a control signal to the driving unit to drive the driving wheels 41 and 42 forward or backward, and thus may move the robot cleaner 1 forward or backward. When the driving wheel 41 as a left driving wheel is moved backward and the driving wheel 42 as a right driving wheel is moved forward, the robot cleaner 1 may rotate leftward. By contrast, when the driving wheel 41 is moved forward and the driving wheel 42 is moved backward, the robot cleaner 1 may rotate rightward.

Figure 8:
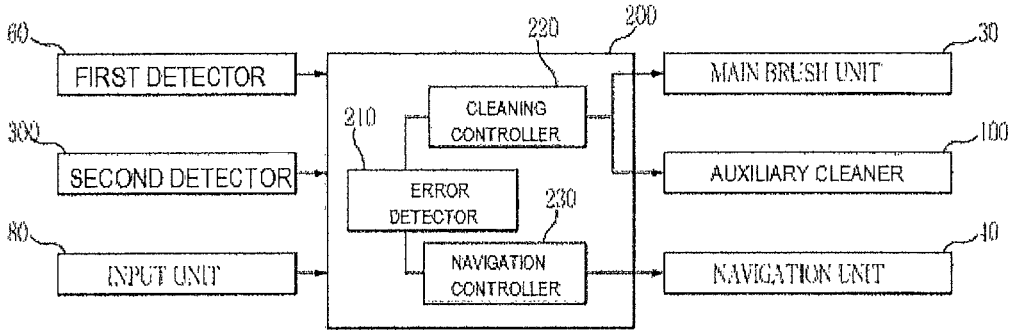
FIG. 8 is a block diagram illustrating a control structure of a controller of a robot cleaner, according to one or more embodiments.

FIG. 8 is a block diagram illustrating a control structure of the controller 200 of a robot cleaner, according to one or more embodiments. The first detector 60, the second detector 300, the input unit 80, the main brush unit 30, the auxiliary cleaner 100, and the navigation unit 40 have already been described and thus an explanation thereof will not be given.

Referring to FIG. 8, the error detector 210 may determine whether the auxiliary cleaner 100 operates abnormally based on a result of a detection of the second detector 300. When the cleaning controller 220 transmits a protrusion or retraction command to the auxiliary cleaner 100 but a result of the detection of the second detector 300 indicates that the auxiliary cleaner 100 does not normally protrude or retract, the error detector 210 may determine that an error has occurred in an operation of the auxiliary cleaner 100.

The cleaning controller 220 may control the main brush unit 30 and the auxiliary cleaner 100 to perform a cleaning operation according to the user's input or a program that is previously stored. In detail, the cleaning controller 220 may generate a cleaning command and may control a motor that drives the main brush unit 30 to be driven, and may generate a protrusion command or a retraction command and may control a motor that drives the auxiliary cleaner 100 to be driven.

The navigation controller 230 may control a navigation path and a navigation speed of the robot cleaner 1 by controlling the navigation unit 40 according to the user's input or a program that is previously stored.

A protrusion or retraction operation of the auxiliary cleaner 100 and a rotation operation of the auxiliary cleaning tool 110 in one or more embodiments may be the same as those described with reference to FIGS. 3 through 6. That is, a protrusion or retraction operation of the auxiliary cleaner 100 may be performed as the arm motor that drives the side arm 102 or the extension arm 107 rotates, and a rotation operation of the auxiliary cleaning tool 110 may be performed as the rotary motor rotates.

A structure of detecting an operation of the auxiliary cleaner 100 and a method of detecting an error of the auxiliary cleaner 100 will be explained in detail. In the following description, a driving unit may include an arm motor that drives a side arm or an extension arm of the auxiliary cleaner 100.

Figure 9:
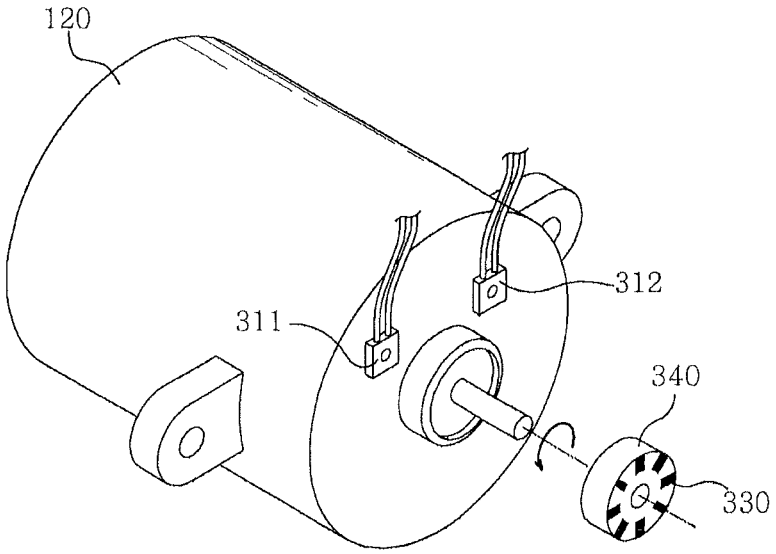
FIG. 9 is a perspective view illustrating a structure of detecting an operation of the auxiliary cleaner, according to one or more embodiments.

FIG. 9 is a perspective view illustrating a structure of detecting an operation of an auxiliary cleaner, such as the auxiliary cleaner 100, according to one or more embodiments.

Referring to FIG. 9, a magnet plate 340 may rotate by being coupled to a rotating shaft of a driving unit 120. Two or more permanent magnets 330 are mounted on the magnet plate 340. The number of the permanent magnets 330 mounted on the magnet plate 340 may vary according to sizes of the permanent magnets 330.

Hall sensors 311 and 312 may be provided on a side of an outer peripheral surface of the driving unit 120. A plurality of the hall sensors 311 and 312 may be provided on the outer peripheral surface of the driving unit 120 with a phase difference of, for example, 120 or 90 degrees.

As the magnet plate 340 rotates, a magnetic field generated by the permanent magnets 330 may be detected by the hall sensors 311 and 312, and the hall sensors 311 and 312 may transmit a square-wave signal to the error detector 210 according to the detected magnetic field.

In this case, the magnet plate 340 may rotate forward or backward according to a rotation direction of the driving unit 120. The error detector 210 may determine the rotation direction of the driving unit 120 according to the magnetic field detected by the plurality of hall sensors 311 and 312.

Figure 10:
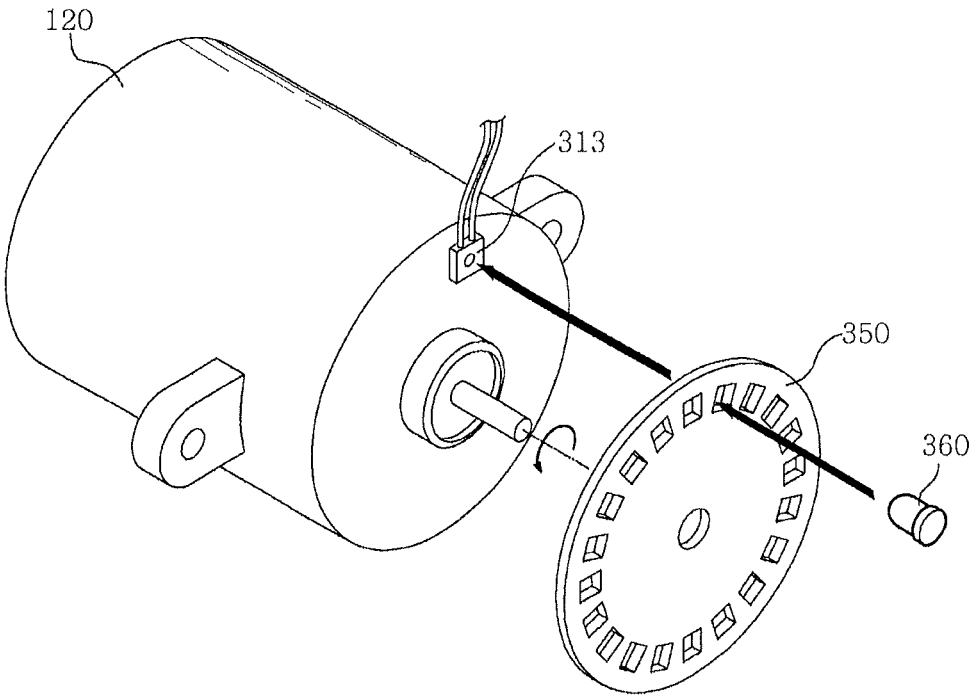
FIG. 10 is a perspective view illustrating a structure of detecting an operation of the auxiliary cleaner, according to one or more embodiments.

FIG. 10 is a perspective view illustrating a structure of detecting an operation of an auxiliary cleaner, such as the auxiliary cleaner 100, according to one or more embodiments.

Referring to FIG. 10, a rotary plate 350 in which a plurality of slits may be formed to block or pass light may be coupled to the rotating shaft of the driving unit 120.

A light-emitting unit 360 that emits light toward the rotary plate 350 may be provided, and a light-receiving unit 313 that receives light may be provided on a side of the outer peripheral surface of the driving unit 120. The light-emitting unit 360 may be, for example, a light-emitting diode (LED), and the light-receiving unit 313 may be, for example, a photo sensor.

As the rotary plate 350 rotates, the light-receiving unit 313 may receive light that has been emitted from the light-emitting unit 360 and has been transmitted through the slits formed in the rotary plate 350. Accordingly, whether the light-receiving unit 313 receives light may be related to whether the driving unit 120 rotates, and a number of times the light-receiving unit 313 receives light may be related to a number of times the driving unit 120 rotates. The light-receiving unit 313 may transmit a square-wave signal to the error detector 210 according to whether light is received.

Figure 11:
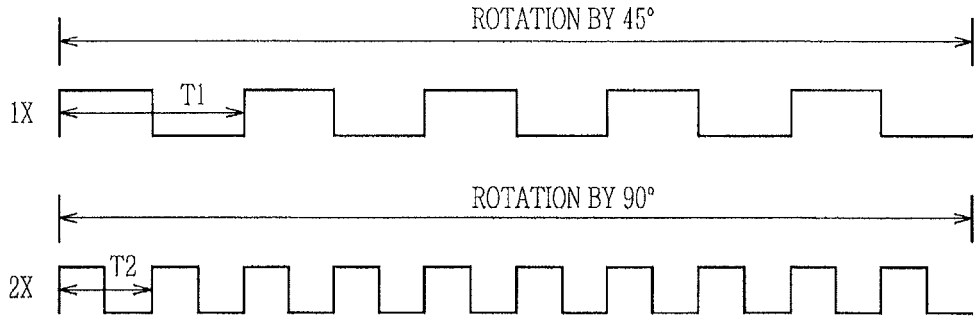
FIG. 11 is a diagram for explaining a method of detecting an error of the auxiliary cleaner, according to one or more embodiments, such as the embodiments shown in FIG. 9 or 10.

FIG. 11 is a diagram for explaining a method of detecting an error of an auxiliary cleaner according to one or more embodiments, such as the auxiliary cleaner 100 of FIG. 9 or 10.

Referring to FIG. 11, the error detector 210 may receive a square-wave signal from the hall sensors 311 and 312 or the light-receiving unit 313.

The error detector 210 may determine a rotation direction of the driving unit 120 according to from which hall sensor a square-wave signal is first received from among the plurality of hall sensors 311 and 312. Accordingly, the error detector 210 may determine whether the auxiliary cleaner 100 performs a protrusion operation or a retraction operation according to whether the rotation direction of the driving unit 120 is a forward direction or a backward direction.

The error detector 210 may calculate a rotation speed of the driving unit 120 according to a cycle of a signal received from the hall sensors 311 and 312 or the light-receiving unit 313. When a signal is received from the hall sensors 311 and 312, a cycle of the signal is inversely proportional to a rotation speed of the driving unit 120 and a number of the permanent magnets 330 mounted on the magnet plate 340. When a signal is received from the light-receiving unit 313, a cycle of the signal is inversely proportional to a rotation speed of the driving unit 120 and a number of the slits formed in the rotary plate 350.

The error detector 210 may calculate a number of times the driving unit 120 rotates by analyzing a square-wave signal received for a preset period of time, and may determine a protrusion or retraction degree of the auxiliary cleaner 100 based on the number of times the driving unit 120 rotates. For example, the error detector 210 may calculate a number of times the driving unit 120 rotates based on a number of times a low level or a high level of a signal is changed.

For example, when a rotation speed of the driving unit 120 is a first speed (1×) as shown in FIG. 11, a number of times a low level or a high level of a signal is changed for a preset period of time may be 5. Likewise, when a rotation speed of the driving unit 120 is a second speed (2×), a number of times a low level or a high level of a signal is changed for a preset period of time may be 10. For example, when a cycle of a signal is repeated 5 times, the rotating shaft of the driving unit 120 may rotate by 45°, and when a cycle of a signal is repeated 10 times, the rotating shaft of the driving unit 120 may rotate by 90°. That is, the error detector 210 may calculate a number of times the driving unit 120 rotates by analyzing a number of times a cycle of a signal is repeated for a preset period of time.

When a number of times a cycle of a signal is changed for a preset period of time is less than a critical value, that is, when a number of times a low level or a high level of a signal is changed is less than a critical value, the error detector 210 may determine that an error has occurred in a protrusion or retraction operation of the auxiliary cleaner 100. The preset period of time may be the same as a time taken for the auxiliary cleaner 100 to normally protrude or retract or a value obtained by adding or subtracting a predetermined period of time to or from the time taken for the auxiliary cleaner 100 to normally protrude or retract.

The error detector 210 may determine whether a protrusion operation or a retraction operation of the auxiliary cleaner 100 is completed based on an accumulated number of times the driving unit 120 rotates.

When a square-wave signal is received from the hall sensors 311 and 312 or the receiving unit 313 and a number of times a cycle of a signal is repeated for a preset period of time is greater than a critical value even though there is no protrusion command or retraction command for the auxiliary cleaner 100, the error detector 210 may determine that the auxiliary cleaner 100 has performed an undesired protrusion operation or retraction operation.

Figure 12:
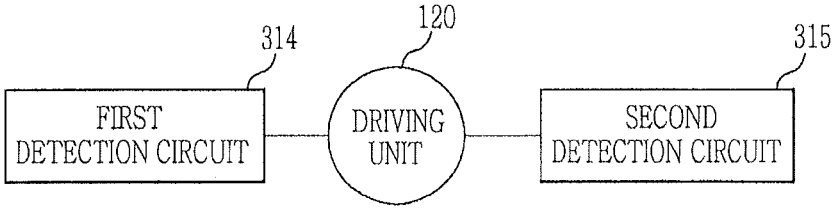
FIG. 12 is a block diagram illustrating a structure of detecting an operation of the auxiliary cleaner, according to one or more embodiments.

FIG. 12 is a block diagram illustrating a structure of detecting an operation of an auxiliary cleaner, such as the auxiliary cleaner 100, according to one or more embodiments.

Referring to FIG. 12, a first detection circuit 314 and a second detection circuit 315 may be provided in the driving unit 120, and each of the first and second detection circuits 314 and 315 may detect a counter-electromotive force generated when the arm motor or the rotary motor rotates.

The first detection circuit 314 and the second detection circuit 315 may be provided at different positions in order to distinguish counter-electromotive forces according to a rotation direction of the driving unit 120. The error detector 210 may determine whether the auxiliary cleaner 100 performs a protrusion operation or a retraction operation according to whether current corresponding to a forward rotation of the driving unit 120 is detected or current corresponding to a backward rotation of the driving unit 120 is detected.

Figure 13:
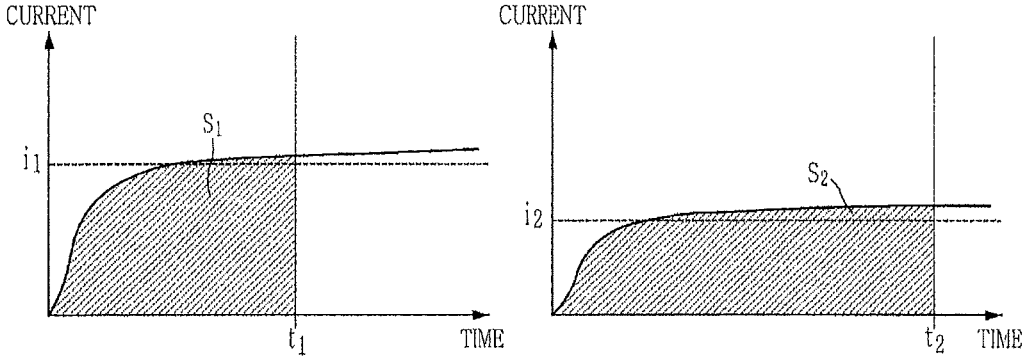
FIG. 13 is a graph for explaining a method of detecting an error of the auxiliary cleaner, according to one or more embodiments, such as the embodiment shown in FIG. 12.

FIG. 13 is a graph for explaining a method of detecting an error of an auxiliary cleaner according to one or more embodiments, such as the auxiliary cleaner 100 of FIG. 12.

Referring to FIG. 13, a current may be supplied from a power supply circuit to the driving unit 120 according to a protrusion command or a retraction command for the auxiliary cleaner 100, and the first detection circuit 314 or the second detection circuit 315 may detect an amount of current generated as the arm motor or the rotary motor supplied with the rotates.

Current supplied to the arm motor or the rotary motor may be proportional to current detected by the first detection circuit 314 or the second detection circuit 315. Since an amount of current detected by the first detection circuit 314 or the first detection circuit 314 may be proportional to a protrusion degree or a retraction degree of the auxiliary cleaner 100, the error detector 210 may determine the protrusion degree or the retraction degree by using the amount of current detected by the first detection circuit 314 or the second detection circuit 315.

For example, current values $i_1$ and $i_2$ may need to be supplied in order to drive and rotate the arm motor or the rotary motor as shown in FIG. 13, and amounts of current $S_1$ and $S_2$ supplied to the arm motor or the rotary motor may be set according to a desired protrusion degree or a desired retraction degree of the auxiliary cleaner 100. Here, the current values $i_1$ and $i_2$ and the amounts of current $S_1$ and $S_2$ supplied to the arm motor or the rotary motor may vary according to a type of the arm motor or the rotary motor, and the amounts of current $S_1$ and $S_2$ supplied to the arm motor or the rotary motor may correspond to values obtained by integrating current values supplied to the arm motor or the rotary motor for periods of time $t_1$ and $t_2$ taken for the auxiliary cleaner 100 to operate normally.

When an amount of current detected by the first detection circuit 314 or the second detection circuit 315 for a preset period of time is less than a critical value, the error detector 210 may determine that an error has occurred in a protrusion or retraction operation of the auxiliary cleaner 100. The preset period of time may be the same as a time taken for the auxiliary cleaner 100 to normally protrude or retract or a value obtained by adding or subtracting a predetermined period of time to or from the time taken for the auxiliary cleaner 100 to normally protrude or retract.

The error detector 210 may determine whether a protrusion operation or a retraction operation of the auxiliary cleaner 100 is completed based on an accumulated amount of current detected by the first detection circuit 314 or the second detection circuit 315.

When current is detected by the first detection circuit 314 or the second detection circuit 315 and an amount of current detected for a preset period of time is greater than a critical value even though there is no protrusion command or retraction command for the auxiliary cleaner 100, the error detector 210 may determine that the auxiliary cleaner 100 has performed an undesired protrusion operation or retraction operation.

Figure 14:
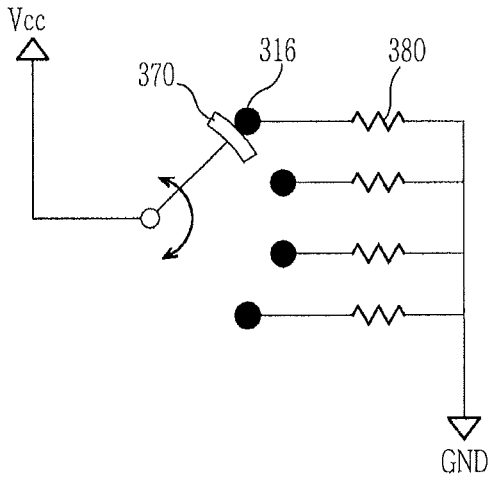
FIGS. 14 and 15 are views illustrating a structure of detecting an operation of the auxiliary cleaner, according to one or more embodiments.
Figure 15:
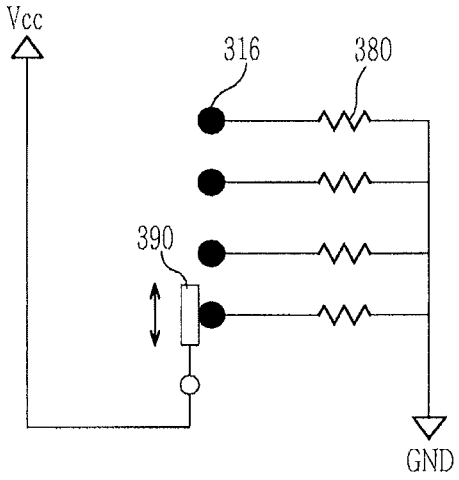

FIGS. 14 and 15 are diagrams illustrating a structure of detecting an operation of an auxiliary cleaner, such as the auxiliary cleaner 100, according to one or more embodiments.

Referring to FIGS. 14 and 15, in order to protrude or retract the auxiliary cleaner 100, a contact detection sensor such as, for example, a micro-switch or a contact switch may be provided in a path through which a predetermined mechanism moves. Examples of a contact detection sensor include a sensor that indirectly detects a contact such as a photo interrupter as well as a sensor that physically detects a contact.

When it is assumed that a predetermined mechanism pivots about a predetermined rotating shaft as shown in FIG. 14, a plurality of contact detection sensors 316 may be provided in a radial direction of a mechanism 370. When it is assumed that a predetermined mechanism linearly moves in a predetermined direction as shown in FIG. 15, a plurality of the contact detection sensors 316 may be provided in a movement direction of a mechanism 390. Accordingly, the error detector 210 may indirectly estimate a position of the auxiliary cleaner 100 by using a contact position between a predetermined mechanism and the contact detection sensors 316.

Although a micro-switch is used as only an example in the following description for convenience of explanation, the present embodiment is not limited thereto. Also, the number of the contact detection sensors 316 may vary according to an accuracy in detecting an operation of the auxiliary cleaner 100, and a resistor 380 may be connected to an end of each of the contact detection sensors 316.

A plurality of micro-switches may be provided to contact a predetermined mechanism in a path through which the predetermined mechanism moves. As the predetermined mechanism moves, a specific micro-switch of the micro-switches may detect a contact, and the error detector 210 may determine whether the auxiliary cleaner 100 performs a protrusion operation or a retract operation based on a position of the specific micro-switch detecting the contact and an order in which contacts are detected.

The error detector 210 may calculate an operation speed of the auxiliary cleaner 100 by using a time and a position of a micro-switch detecting a contact, and may determine whether a protrusion operation or a retraction operation of the auxiliary cleaner 100 is completed based on a final position of a micro-switch detecting a contact.

When a contact between a mechanism and a micro-switch of a predicted position within a preset period of time is not detected, the error detector 210 may determine that an error occurs in a protrusion or retraction operation of the auxiliary cleaner 100. The preset period of time may be the same as a time taken for the auxiliary cleaner 100 to normally protrude or retract or a value obtained by adding or subtracting a predetermined period of time to or from the time taken for the auxiliary cleaner 100 to normally protrude or retract as described above.

When a position of the auxiliary cleaner 100 is changed and a contact between a mechanism and a micro-switch of a specific position is detected even though there is no protrusion command or retraction command for the auxiliary cleaner 100, the error detector 210 may determine that the auxiliary cleaner 100 performs an undesired protrusion operation or retraction operation.

A method of controlling the robot cleaner 1 according to the structures of detecting an error of the auxiliary cleaner 100 will be explained.

Figure 16:
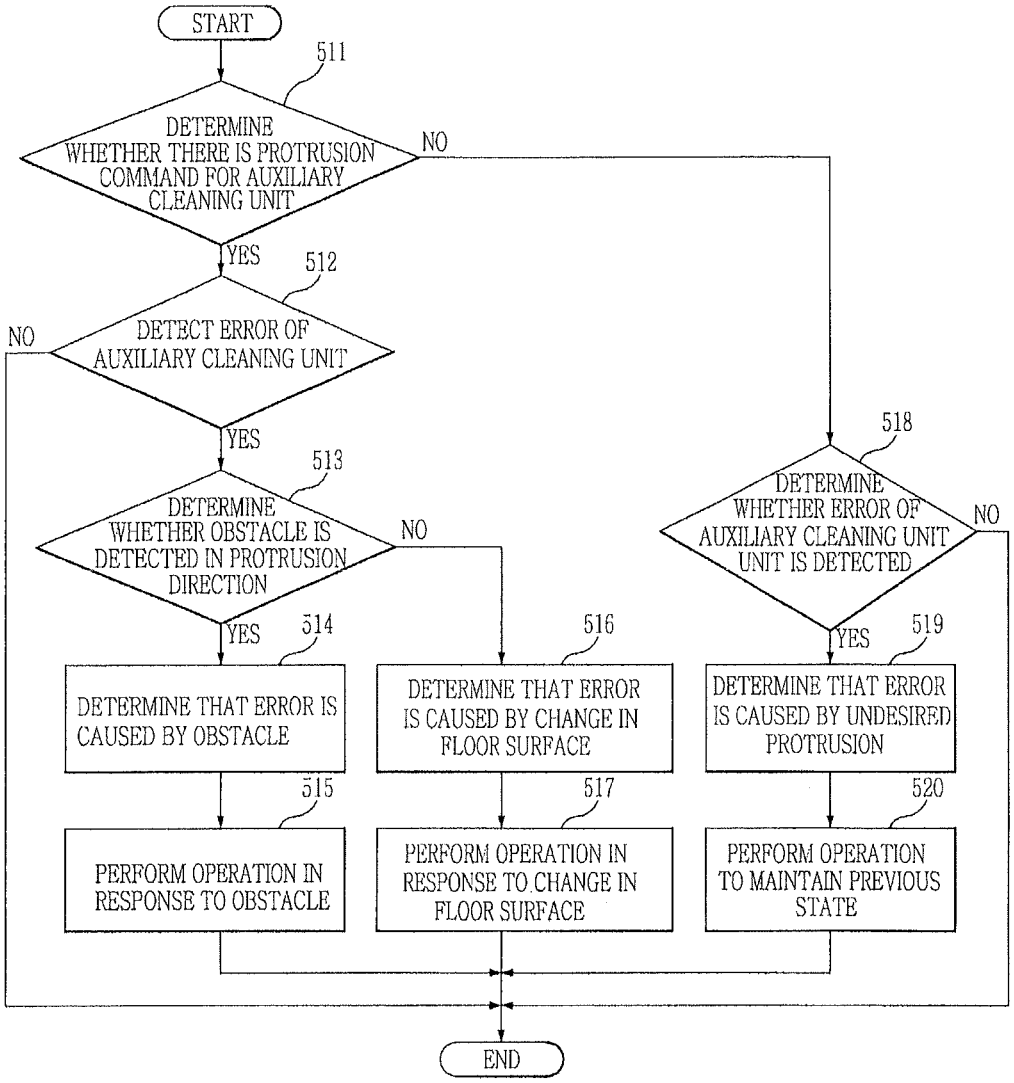
FIG. 16 is a flowchart illustrating a method of controlling the robot cleaner in a case where an error occurs when the auxiliary cleaner protrudes, according to one or more embodiments.

FIG. 16 is a flowchart illustrating a method of controlling a robot cleaner in a case where an error occurs when an auxiliary cleaner, such as the auxiliary cleaner 100, protrudes, according to one or more embodiments.

Referring to FIG. 16, in operation 511, the controller 200 may determine whether a protrusion command for the auxiliary cleaner 100 is generated.

When it is determined in operation 511 that there is a protrusion command for the auxiliary cleaner 100, the method may proceed to operation 512. In operation 512, the controller 200 may determine whether an error is detected in a protrusion operation of the auxiliary cleaner 100 based on a result obtained when the second detector 300 detects the auxiliary cleaner 100.

When it is determined in operation 512 that an error is detected in a protrusion operation of the auxiliary cleaner 100, the method may proceed to operation 513. In operation 513, the first detector 60 may determine whether an obstacle is detected in the protrusion direction of the auxiliary cleaner 100.

When it is determined in operation 513 that an obstacle is detected in the protrusion direction of the auxiliary cleaner 100, the method may proceed to operation 514. In operation 514, the controller 200 may determine that the error of the auxiliary cleaner 100 is caused by the obstacle (for example, a state where the auxiliary cleaner 100 fails to protrude due to a collision with the obstacle). In operation 515, the controller 200 may perform an operation in response to the obstacle. In this case, the controller 200 may perform a retraction operation of the auxiliary cleaner 100 in response to the obstacle. Also, the controller 200 may change a navigation direction and a navigation pattern of the robot cleaner 1 in response to the obstacle.

When it is determined in operation 513 that an obstacle is not detected in the protrusion direction of the auxiliary cleaner 100, the method may proceed to operation 516. In operation 516, the controller 200 may determine that the error of the auxiliary cleaner 100 is caused by a change in a floor surface (for example, a state where the floor surface is changed to a floor surface formed of a material with high resistance such as a carpet). In operation 517, the controller 200 may perform an operation in response to the change in the floor surface. In this case, the controller 200 may perform a retraction operation of the auxiliary cleaner 100 in response to the change in the floor surface. Also, the controller 200 may adjust a protrusion strength of the auxiliary cleaner 100 in response to the change in the floor surface. To this end, the controller 200 may adjust current supplied to the arm motor that protrudes the auxiliary cleaner 100.

When it is determined in operation 511 that there is no protrusion command for the auxiliary cleaner 100, the method may proceed to operation 518. In operation 518, the controller 200 may determine whether an error is detected in a protrusion operation of the auxiliary cleaner 100 based on a result obtained when the second detector 300 detects the auxiliary cleaner 100. In this case, the controller 200 may additionally determine whether the robot cleaner 1 is in a navigation mode.

When it is determined in operation 518 that an error is detected in a protrusion operation of the auxiliary cleaner 100, the method may proceed to operation 519. In operation 519, the controller 200 may determine that the error of the auxiliary cleaner 100 is caused by an undesired protrusion (for example, a state where the robot cleaner 1 is lowered by the user and the auxiliary cleaner 100 protrudes downward). In operation 520, the controller 200 may determine that the undesired protrusion is caused by an external force applied by the user, and may control the driving unit 120 to resist the external force in order to maintain a previous state.

Figure 17:
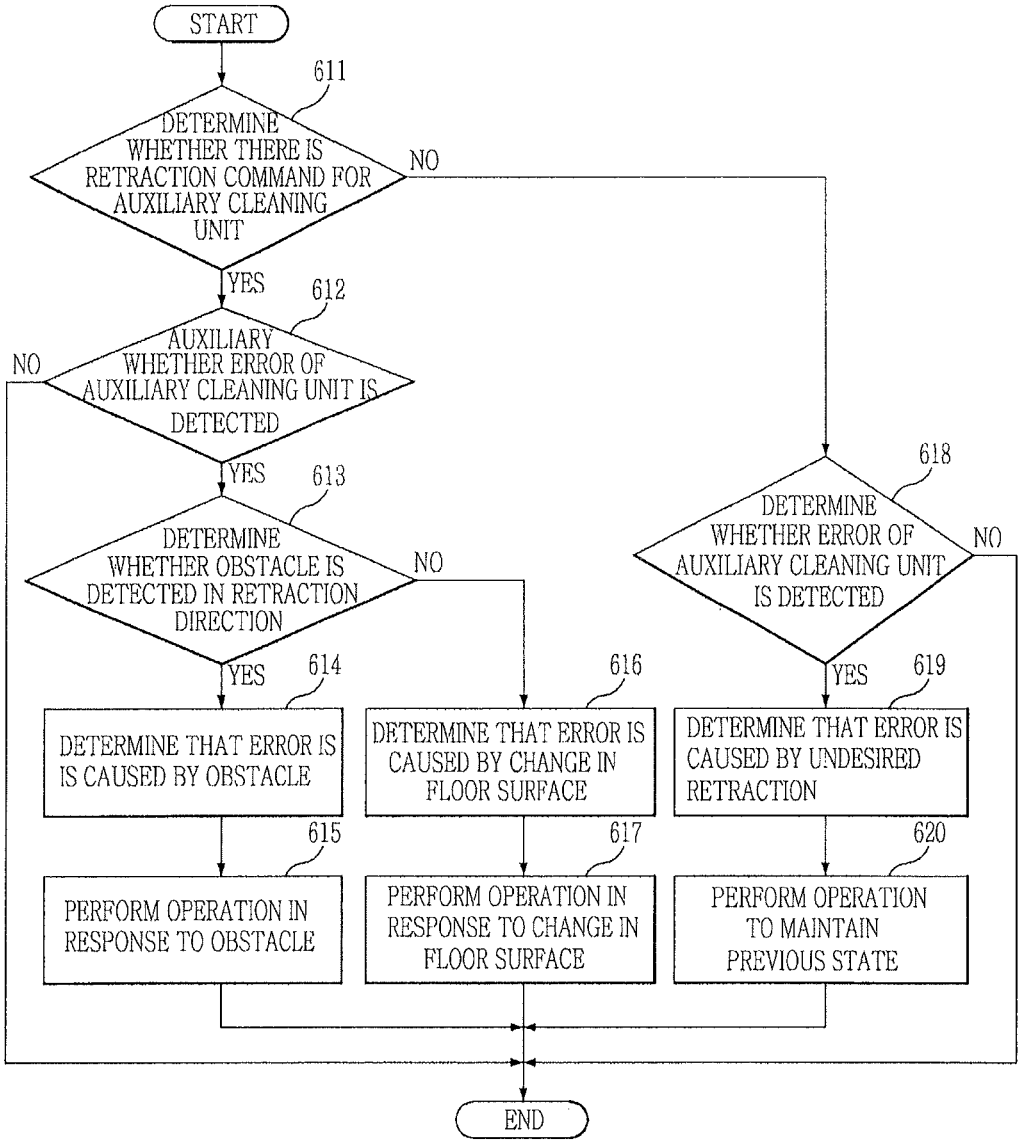
FIG. 17 is a flowchart illustrating a method of controlling the robot cleaner in a case where an error occurs when the auxiliary cleaning retracts, according to one or more embodiments.

FIG. 17 is a flowchart illustrating a method of controlling a robot cleaner in a case where an error occurs when an auxiliary cleaner, such as the auxiliary cleaner 100 retracts, according to one or more embodiments.

Referring to FIG. 17, in operation 611, the controller 200 may determine whether a retraction command for the auxiliary cleaner 100 is generated.

When it is determined in operation 611 that there is a retraction command for the auxiliary cleaner 100, the method may proceed to operation 612. In operation 612, the controller 200 may determine whether an error is detected in a retraction operation of the auxiliary cleaner 100 based on a result obtained when the second detector 300 detects the auxiliary cleaner 100.

When it is determined in operation 612 that an error is detected in a retraction operation of the auxiliary cleaner 100, the method may proceed to operation 613. In operation 613, the first detector 60 may determine whether an obstacle is detected in the retraction direction of the auxiliary cleaner 100.

When it is determined in operation 613 that an obstacle is detected in the retraction direction of the auxiliary cleaner 100, the method may proceed to operation 614. In operation 614, the controller 200 may determine that the error of the auxiliary cleaner 100 is caused by the obstacle (for example, a state where the auxiliary cleaner 100 fails to retract due to the obstacle disposed between the auxiliary cleaner 100 and the main body 10). In operation 615, the controller 200 may perform an operation in response to the obstacle. In this case, the controller 200 may maintain a protrusion state of the auxiliary cleaner 100 for a predetermined period of time in response to the obstacle. Also, the controller 200 may change a navigation direction and a navigation pattern of the robot cleaner 1 in response to the obstacle.

When it is determined in operation 613 that an obstacle is not detected in the retraction direction of the auxiliary cleaner 100, the method may proceed to operation 616. In operation 616, the controller 200 may determine that the error of the auxiliary cleaner 100 is caused by a change in a floor surface (for example, a state where the floor surface is changed to a floor surface formed of a material with high resistance such as a carpet). In operation 617, the controller 200 may perform an operation in response to the change in the floor surface. In this case, the controller 200 may perform a protrusion operation of the auxiliary cleaner 100 in response to the change in the floor surface. Also, the controller 200 may adjust a retraction strength of the auxiliary cleaner 100 in response to the change in the floor surface. To this end, the controller 200 may adjust current supplied to the arm motor that retracts the auxiliary cleaner 100.

When it is determined in operation 611 that there is no retraction command for the auxiliary cleaner 100, the method may proceed to operation 618. In operation 618, the controller 200 may determine whether an error is detected in a retraction operation of the auxiliary cleaner 100 based on a result obtained when the second detector 300 detects the auxiliary cleaner 100. In this case, the controller 200 may additionally determine whether the robot cleaner 1 is in a navigation mode.

When it is determined in operation 618 that an error is detected in a retraction operation of the auxiliary cleaner 100, the method may proceed to operation 619. In operation 619, the controller 200 may determine that the error of the auxiliary cleaner 100 is caused by an undesired retraction (for example, a state where the user arbitrarily presses down the auxiliary cleaner 100 that is protruding. In operation 620, the controller 200 may determine that the undesired retraction is caused by an external force applied by the user, and may control the driving unit 120 to resist the external force in order to maintain a previous state.

Although two auxiliary cleaning units 100 may be provided on both side portions of the robot cleaner 1 in the above-mentioned embodiments, the embodiments are not limited thereto, and a number and positions of the auxiliary cleaning units 100 are not limited. Each of the auxiliary cleaning units 100 may protrude or retract, and a method of controlling the robot cleaner 1 which may be performed when an error occurs in an operation of each of the auxiliary cleaning units 100 may be applied to each of the auxiliary cleaning units 100.

In one or more embodiments, any apparatus, system, element, or interpretable unit descriptions herein include one or more hardware devices or hardware processing elements. For example, in one or more embodiments, any described apparatus, system, element, retriever, pre or post-processing elements, tracker, detector, encoder, decoder, etc., may further include one or more memories and/or processing elements, and any hardware input/output transmission devices, or represent operating portions/aspects of one or more respective processing elements or devices. Further, the term apparatus should be considered synonymous with elements of a physical system, not limited to a single device or enclosure or all described elements embodied in single respective enclosures in all embodiments, but rather, depending on embodiment, is open to being embodied together or separately in differing enclosures and/or locations through differing hardware elements.

In addition to the above described embodiments, embodiments can also be implemented through computer readable code/instructions in/on a non-transitory medium, e.g., a computer readable medium, to control at least one processing device, such as a processor or computer, to implement any above described embodiment. The medium can correspond to any defined, measurable, and tangible structure permitting the storing and/or transmission of the computer readable code.

The media may also include, e.g., in combination with the computer readable code, data files, data structures, and the like. One or more embodiments of computer-readable media include: magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Computer readable code may include both machine code, such as produced by a compiler, and files containing higher level code that may be executed by the computer using an interpreter, for example. The media may also be any defined, measurable, and tangible distributed network, so that the computer readable code is stored and executed in a distributed fashion. Still further, as only an example, the processing element could include a processor or a computer processor, and processing elements may be distributed and/or included in a single device.

The computer-readable media may also be embodied in at least one application specific integrated circuit (ASIC) or Field Programmable Gate Array (FPGA), as only examples, which execute (e.g., processes like a processor) program instructions.

While aspects of the present invention has been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A robot cleaner comprising:

a main body that navigates a floor;

a first detector that detects an obstacle;

an auxiliary cleaner that is mounted on the main body to protrude and retract;

a second detector that detects a protrusion state or a retraction state of the auxiliary cleaner; and a controller that determines an abnormal operation of the auxiliary cleaner based on a result of the detection of the second detector and controls a protrusion operation or a retraction operation of the auxiliary cleaner according to a result of the determination.

2. The robot cleaner of claim 1, wherein the second detector detects whether the auxiliary cleaner performs a protrusion operation or a retraction operation, detects a protrusion degree or a retraction degree of the auxiliary cleaner, and detects whether the protrusion operation or the retraction operation of the auxiliary cleaner is completed.

3. The robot cleaner of claim 2, wherein the controller calculates a number of times a driving unit that drives the auxiliary cleaner rotates based on the result of the detection of the second detector, and when the number of times the driving unit rotates for a preset period of time is less than a critical value, determines that an error occurs in an operation of the auxiliary cleaner.

4. The robot cleaner of claim 2, wherein the controller calculates a number of times a driving unit that drives the auxiliary cleaner rotates based on the result of the detection of the second detector, and when the number of times the driving unit rotates for a preset period of time is greater than a critical value and there is no protrusion or retraction command for the auxiliary cleaner, determines that an error occurs in an operation of the auxiliary cleaner.

5. The robot cleaner of claim 2, wherein the controller calculates an amount of current supplied to a driving unit that drives the auxiliary cleaner based on the result of the detection of the second detector, and when the amount of current supplied to the driving unit for a preset period of time is less than a critical value, determines that an error occurs in an operation of the auxiliary cleaner.

6. The robot cleaner of claim 2, wherein the controller calculates an amount of current supplied to a driving unit that drives the auxiliary cleaner based on the result of the detection of the second detector, and when the amount of current supplied to the driving unit for a preset period of time is greater than a critical value and there is no protrusion or retraction command for the auxiliary cleaner, determines that an error occurs in an operation of the auxiliary cleaner.

7. The robot cleaner of claim 2, wherein the controller estimates a position of the auxiliary cleaner based on the result of the detection of the second detector, and when the auxiliary cleaner is not located at a predicted position within a preset period of time, determines that an error occurs in an operation of the auxiliary cleaner.

8. The robot cleaner of claim 2, wherein the controller estimates a position of the auxiliary cleaner based on the result of the detection of the second detector, and when there is a change in the position of the auxiliary cleaner and there is no protrusion or retraction command for the auxiliary cleaner, determines that an error occurs in an operation of the auxiliary cleaner.

9. The robot cleaner of claim 2, wherein when an obstacle is detected in a protrusion or retraction direction of the auxiliary cleaner based on the result of the detection of the first detector, the controller determines that the auxiliary cleaner operates abnormally due to the obstacle.

10. The robot cleaner of claim 9, wherein the controller performs a protrusion or retraction operation of the auxiliary cleaner or changes a navigation direction and a navigation pattern of the main body in response to the obstacle.

11. The robot cleaner of claim 2, wherein when no obstacle is detected in a protrusion or retraction direction of the auxiliary cleaner based on the result of the detection of the first detector, the controller determines that the auxiliary cleaner abnormally operates due to a change in a floor surface.

12. The robot cleaner of claim 11, wherein the controller performs a protrusion or retraction operation of the auxiliary cleaner or adjusts an operation strength of the auxiliary cleaner in response to the change in the floor surface.

13. The robot cleaner of claim 2, wherein when a protrusion or retraction operation of the auxiliary cleaner is detected based on the result of the detection of the second detector and there is no operation command for the auxiliary cleaner, the controller determines that an undesired operation occurs.

14. The robot cleaner of claim 13, wherein the controller determines that the undesired operation is caused by an external force and controls the auxiliary cleaner to resist the external force.

15. A method of controlling a robot cleaner comprising a main body that navigates a floor, a first detector that detects an obstacle, an auxiliary cleaner that is mounted on the main body to protrude and retract, and a second detector that detects a protrusion or retraction state of the auxiliary cleaner, the method comprising:

determining an abnormal operation of the auxiliary cleaner based on a result of the detection of the second detector; and controlling a protrusion or retraction operation of the auxiliary cleaner according to a result of the determination.

16. The method of claim 15, wherein the controlling of the protrusion or retraction operation of the auxiliary cleaner comprises:

determining whether an obstacle is detected in a protrusion or retraction direction of the auxiliary cleaner;

determining whether the auxiliary cleaner abnormally operates due to the obstacle when it is determined that the obstacle is detected; and performing a protrusion or retraction operation of the auxiliary cleaner or changing a navigation direction and a navigation pattern of the main body in response to the obstacle.

17. The method of claim 15, wherein the controlling of the protrusion or retraction operation of the auxiliary cleaner comprises:

determining whether an obstacle is detected in a protrusion or retraction direction of the auxiliary cleaner;

determining that the auxiliary cleaner abnormally operates according to a change in a floor surface when the obstacle is not detected; and performing a protrusion or retraction operation of the auxiliary cleaner or adjusting an operation strength of the auxiliary cleaner in response to the change in the floor surface.

18. The method of claim 15, further comprising determining whether there exists an operation command for the auxiliary cleaner, wherein the determining of the abnormal operation of the auxiliary cleaner comprises determining whether a protrusion or retraction operation of the auxiliary cleaner is detected based on the result of the detection of the second detector and there is no operation command for the auxiliary cleaner.

19. The method of claim 18, wherein the controlling of the protrusion or retraction operation of the auxiliary cleaner comprises:

determining that an undesired operation occurs when the protrusion or retraction operation of the auxiliary cleaner is detected; and determining that the undesired operation is caused by an external force, and controlling the auxiliary cleaner to resist the external force in order to maintain a previous state.

20. A robot cleaner comprising:

a main body that navigates a floor;

an auxiliary cleaner that is mounted on the main body to protrude and retract;

a first detector that detects a protrusion state or a retraction state of the auxiliary cleaner; and a controller that determines an abnormal operation of the auxiliary cleaner based on a result of the detection of the first detector and controls a protrusion operation or a retraction operation of the auxiliary cleaner according to a result of the determination.

21. The robot cleaner of claim 20, wherein the first detector detects whether the auxiliary cleaner performs a protrusion operation or a retraction operation, detects a protrusion degree or a retraction degree of the auxiliary cleaner, and detects whether the protrusion operation or the retraction operation of the auxiliary cleaner is completed, and wherein the controller determines whether there is a protrusion or retraction command for the auxiliary cleaner.

22. The robot cleaner of claim 21, wherein the controller determines that an error occurs in an operation of the auxiliary cleaner when the first detector detects that the auxiliary cleaner performs a protrusion operation or a retraction operation and the controller determines that there is no protrusion or retraction command for the auxiliary cleaner.

23. The robot cleaner of claim 21, wherein the controller determines that an error occurs in an operation of the auxiliary cleaner when the first detector detects that the auxiliary cleaner does not perform a protrusion operation or a retraction operation and the controller determines that there is a protrusion or retraction command for the auxiliary cleaner.

24. The robot cleaner of claim 21, wherein the controller estimates a position of the auxiliary cleaner based on the result of the detection of the first detector, and when the auxiliary cleaner is not located at a predicted position within a preset period of time, determines that an error occurs in an operation of the auxiliary cleaner.

25. The robot cleaner of claim 21, wherein the controller estimates a position of the auxiliary cleaner based on the result of the detection of the first detector, and when there is a change in the position of the auxiliary cleaner and there is no protrusion or retraction command for the auxiliary cleaner, determines that an error occurs in an operation of the auxiliary cleaner.

26. The robot cleaner of claim 21, the robot cleaner further comprising a second detector that detects an obstacle, wherein when an obstacle is detected in a protrusion or retraction direction of the auxiliary cleaner based on the result of the detection of the second detector, the controller determines that the auxiliary cleaner operates abnormally due to the obstacle.

* * * * *